US007191867B2

(12) United States Patent
Schmitt

(10) Patent No.: US 7,191,867 B2
(45) Date of Patent: Mar. 20, 2007

(54) HEARING AID DEVICE THAT CAN BE WORN IN THE EAR WITH A HOUSING

(75) Inventor: Christian Schmitt, Grossenseebach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 405 days.

(21) Appl. No.: 10/670,935

(22) Filed: Sep. 25, 2003

(65) Prior Publication Data

US 2004/0112670 A1 Jun. 17, 2004

(30) Foreign Application Priority Data

Sep. 25, 2002 (EP) ..... 02021477

(51) Int. Cl.
*H04R 25/02* (2006.01)
*H04R 25/00* (2006.01)

(52) U.S. Cl. ..... 181/130; 181/135; 381/324; 381/329

(58) Field of Classification Search ..... 181/130, 181/135, 129; 381/324, 329
See application file for complete search history.

(56) References Cited

U.S. PATENT DOCUMENTS 2,975,226 A * 3/1961 Lehr ..... 429/97
4,272,591 A * 6/1981 Brander ..... 429/98
4,584,437 A * 4/1986 Giannetti ..... 381/324
4,680,799 A * 7/1987 Henneberger ..... 381/324
4,815,138 A * 3/1989 Diethelm ..... 381/323
4,831,655 A * 5/1989 Buettner ..... 381/322
5,201,008 A * 4/1993 Arndt et al. ..... 381/323
5,588,064 A * 12/1996 McSwiggen et al. ..... 381/312
5,784,470 A * 7/1998 Fackler et al. ..... 381/328
5,889,874 A * 3/1999 Schmitt et al. ..... 381/328
2003/0185413 A1* 10/2003 Schmitt ..... 381/322
2005/0157898 A1* 7/2005 Gabathuler ..... 381/322

FOREIGN PATENT DOCUMENTS

EP 0 311 233 A2 5/1988
EP 453200 A2 * 10/1991
EP 0 988 776 B1 3/2001
WO WO 98 47319 A 10/1998

* cited by examiner

*Primary Examiner*—Edgardo San Martin
(74) *Attorney, Agent, or Firm*—Schiff Hardin LLP

(57) ABSTRACT

In a hearing aid device wearable in the ear with a housing, the battery loader is exposed to high mechanical stresses. In order to improve the attachment of the battery loader to the housing of the hearing aid device, the invention provides for the battery loader at the housing in the area of the housing opening a stabilization element that prevents deformations and in particular distortions of the housing in the area of the housing opening given high mechanical stress.

5 Claims, 2 Drawing Sheets

HEARING AID DEVICE THAT CAN BE WORN IN THE EAR WITH A HOUSING

BACKGROUND OF THE INVENTION

The present invention concerns a hearing aid device with a housing that can be worn in the ear, that comprises at least one acceptance mechanism for a pivoted attachment, and a housing opening to swivel in and swivel out a battery loader.

Hearing aid devices that can be worn in the ear (ITE) possess a housing that is individually adapted to the auditory canal of a hearing device user. In the production of the housing, a housing opening to insert a battery is fashioned on the side facing the eardrum, which is also designated as a faceplate. The housing is subsequently connected with a battery loader in which the battery can be inserted and introduced into the housing through the housing opening. The battery loader comprises a cover, such that, given a closed battery loader, the housing opening is covered in the housing of the hearing aid device wearable in the ear.

Such a hearing aid device wearable in the ear with a housing, a housing opening, and a battery loader is, for example, known from European patent document EP 0 988 776 B1. The hearing aid device shown therein furthermore comprises an electronic module that can likewise be inserted through the housing opening in the housing of the hearing aid device and attached to the housing of the hearing aid device by way of guiding grooves and attachment clips. The battery loader, which thus comprises no direct connection to the housing of the hearing aid device, is finally linked to the electronic module.

However, other embodiments are also known in which the battery loader is connected directly pivoted with the housing of the hearing aid device wearable in the ear. European patent document EP 0 311 233 A2, for example, shows such a hearing aid device. Frequently, hearing aid devices wearable in the ear are pulled from the auditory canal of a hearing device user by pulling on the open battery loader. Upon extraction, comparatively large forces affect the attachment elements of the battery loader. Damage to the attachment can thereby ensue, even an undesired loosening of the battery loader from the housing of the hearing aid device.

SUMMARY OF THE INVENTION

It is therefore the object of the present invention to provide a different attachment of a battery loader to the housing of a hearing aid device wearable in the ear that reduces/eliminates these problems.

This object is achieved in a hearing aid device wearable in the ear with a housing, comprising at least one acceptance mechanism for a pivoted attachment, and a housing opening to swivel in and swivel out a battery loader, via a stabilizing element attached to the housing and at least partially surrounding the housing opening, to stabilize the housing in the area of the housing opening.

In the production of a hearing aid device wearable in the ear, typically an ear impression of the hearing device user is taken. With the aid of the ear impression, a housing shell is then finished that is individual-adapted to the auditory canal of the hearing device user. The end of the housing shell facing the eardrum is initially open and is provided in a subsequent finishing step with a cover plate. However, production methods are also known in which the housing output signal the hearing aid device wearable in the ear is fashioned in a one-piece manner. For example, not only the housing parts abutting the auditory canal, but rather also the housing end facing the eardrum, are finished in a laser-sinter process. The production of an independent cover plate is then no longer necessary.

The embodiment of the invention effects a stabilization and, in particular, stiffening of the housing in the area of the housing opening that is provided to swivel the battery loader in, and therewith to insert the battery, and thus effects an inventive attachment of the battery loader in this housing area. In particular, given extraction of the hearing aid device from the ear canal, a distortion of the housing in the area of the acceptance of the battery loader is prevented that could otherwise lead to unintended loosening of the battery loader from the housing.

The stabilization element can be mounted on the housing topside, the housing underside, or on both sides, and at least partially surrounds the housing opening. However, the stabilization element output signal is preferably inserted into the housing opening and attached at the border area in at least two points with the border area of the housing that surrounds the housing opening. For attachment, the stabilization element preferably comprises clamp elements that can be implemented in a simple manner as moldings. In the assembly of the hearing aid device, the stabilization element is then merely clipped into the housing opening.

In an embodiment of the invention, to fasten the battery loader to two opposite sides of the housing opening, an acceptance is provided per each side in which the fastening pins engage with the battery loader. The fastening pins are preferably also inserted through holes in the stabilization element such that the stabilization element not only effects a stiffening of the housing in the area of the acceptances for the battery loader, but also directly improves the attachment of the battery loader to the housing.

The stabilization element is preferably made of a metal or a metal alloy, such that, despite its small size, it offers a good protection from distortions.

DESCRIPTION OF THE DRAWINGS

The invention is subsequently more closely explained using an exemplary embodiment illustrated by the drawings.

DETAILED DESCRIPTION OF THE PREFERRED EMBODIMENTS

Figure 1:
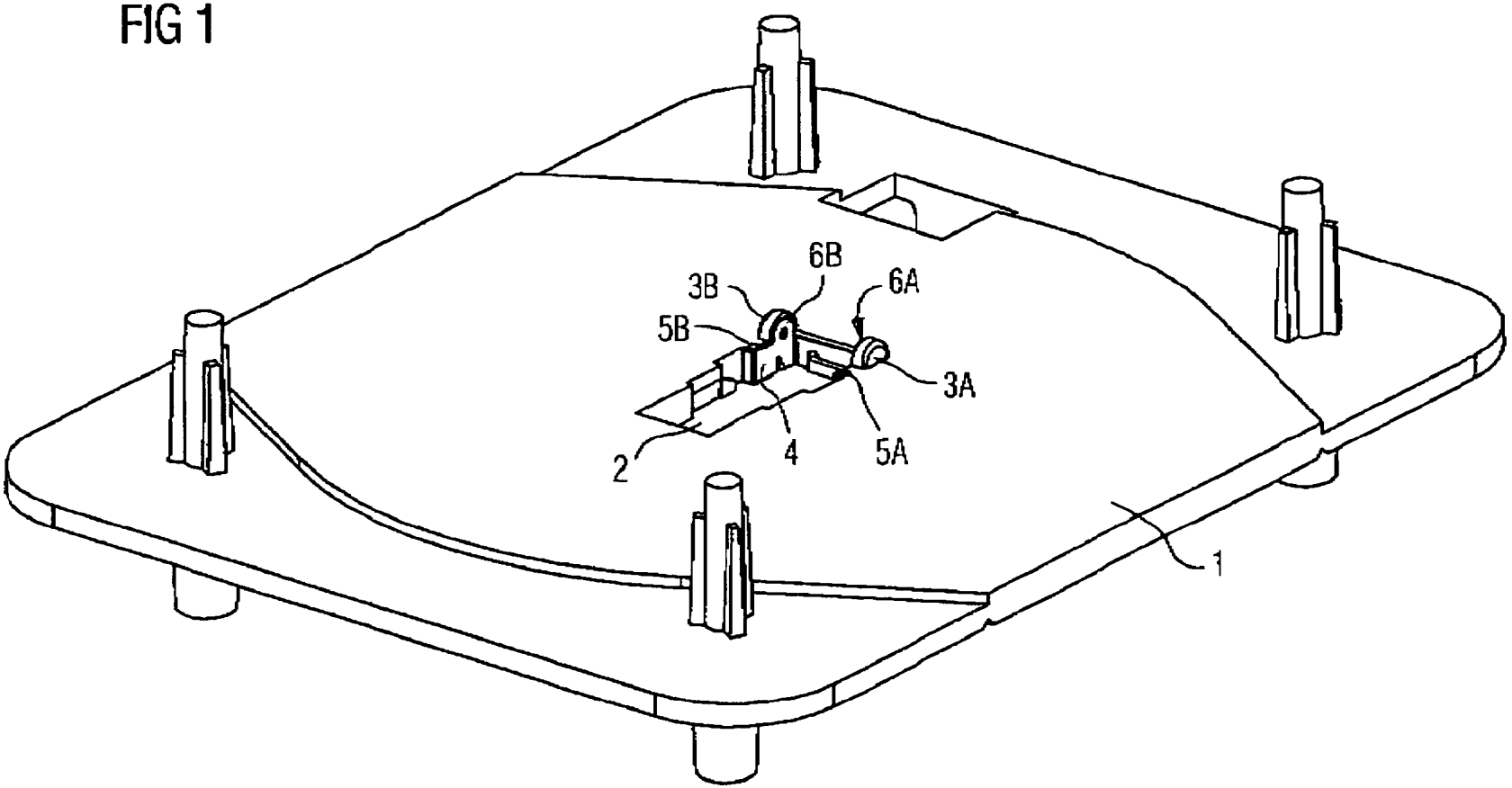
FIG. 1 is a pictorial drawing of a cover plate for a hearing aid device wearable in the ear in which a stabilization element is located in a housing opening to insert a battery.

FIG. 1 shows an exemplary embodiment of the invention with a separate finished cover plate 1. This is generally implemented as a plastic-injection molding part. In the cover plate 1, an opening 2 is located through which a battery can be inserted into the hearing aid device in the finished assembled housing shell. The opening in the exemplary embodiment is dimensioned large enough so that, in addition to the battery, further components of the hearing aid device such as the signal processing electronics or the earpiece can advantageously also be inserted into the housing. The components can then also be removed again through this housing opening, for example, in the event of repair. The cover plate 1 is furthermore provided with two acceptances 3A and 3B in which pegs can be inserted to attach a battery loader. A hinge joint exists via the acceptances 3A and 3B and the pegs that can be inserted therein.

According to this embodiment, a stabilization element 4 can be inserted into the housing opening 2 as an independent component. This is preferably fashioned as a metal clip and clasps the cover plate 1 in the area of two opposite areas 5A and 5B of the cover plate 1 in the housing opening 2. The stabilization element 4 stabilizes and stiffens the cover plate 1, particularly in the area of the housing opening 2.

As can be further seen from the FIG. 1, two grommets 6A and 6B that abut the acceptances 3A and 3B are fashioned as one piece at the stabilization element 4.

Figure 2:
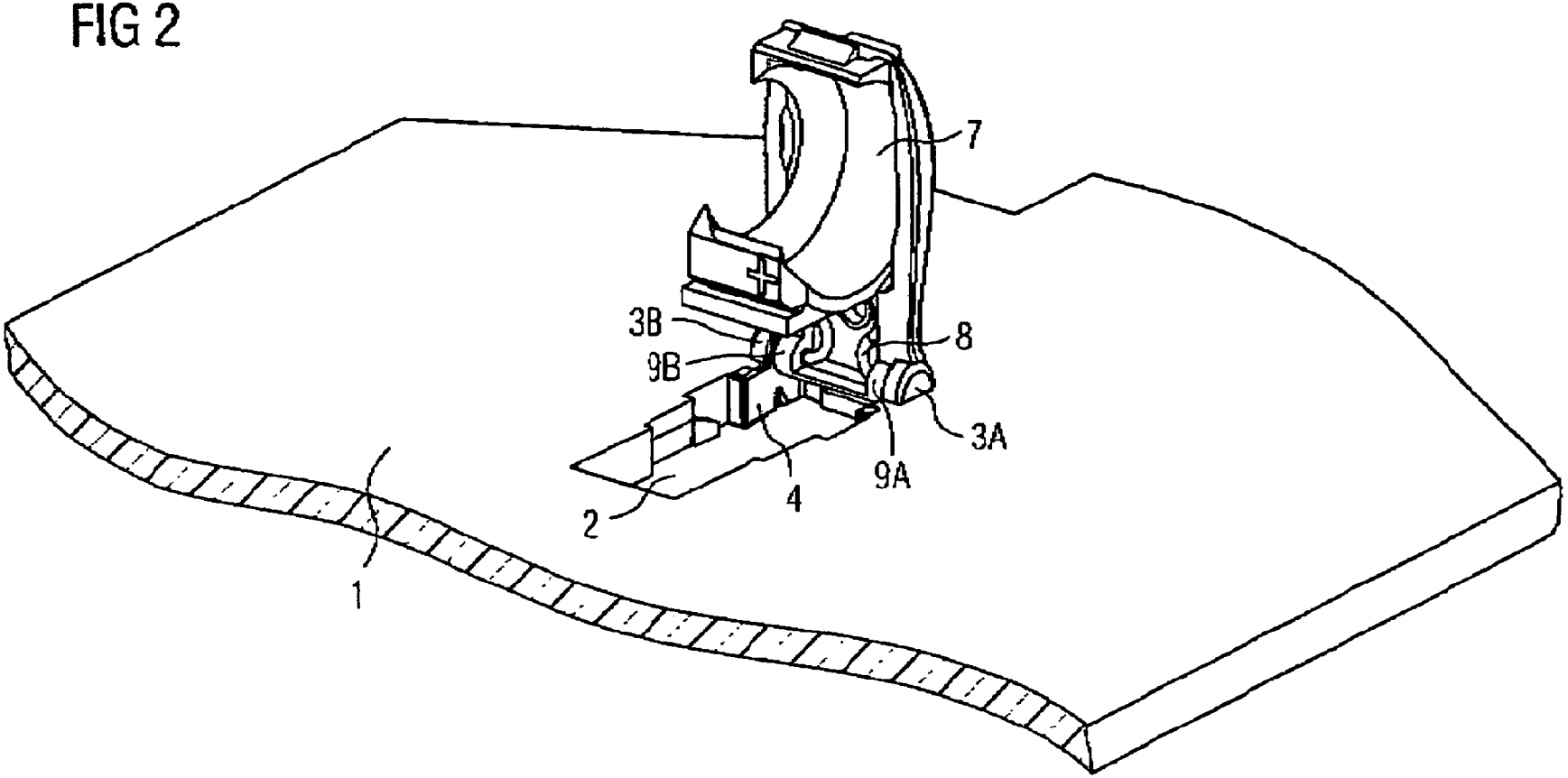
FIG. 2 is a pictorial drawing of the cover plate according to FIG. 1 with an inserted battery loader.

FIG. 2 shows the cover plate 1 with the housing opening 2, the stabilization element 4, and the acceptances 3A and 3B, to which a battery loader 7 is attached in a pivoted manner. The articulation comprises a spring element 8, substantially omega-shaped, whose ends respectively run in the stabilization element 4 through a guide 9A or, respectively, 9B and protrude into the acceptances 3A or, respectively, 3B. Between the guides 9A or, respectively, 9B and the acceptances 3A or, respectively, 3B are located the grommets 6A or, respectively, 6B (visible from FIG. 1) of the stabilization element 4, with which an additional stabilization of the battery loader 7 is achieved.

The invention is achieved via a very space-saving but nevertheless stable attachment of the battery loader 7 to the housing of a hearing aid device wearable in the ear. Furthermore, higher manufacturing tolerances can thereby be allowed in the battery loader 7 or, respectively, the housing opening 2. Overall, a further miniaturization of hearing device housings is thus enabled given a simultaneous increased stability. Moreover, the battery loader 7 and the cover plate 1 can be made via the invention from different as well as porous materials.

Numerous embodiments alternative to the exemplary shown embodiment of a stabilization element 4 are possible. In particular, a closed embodiment can surround the housing opening 2 on all sides.

In summary, these embodiments show a hearing aid device wearable in the ear with a housing, the battery loader being exposed to higher mechanical stresses. In order to improve the attachment of the battery loader to the housing of the hearing aid device, a stabilization element is provided for the battery loader at the housing, in the area of the housing opening, that prevents deformations and in particular distortions of the housing in the area of the housing opening given high mechanical stress.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the systems) may not be described in detail. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 cover plate
2 housing opening
3A, 3B acceptances
4 stabilization element
5A, 5B areas of the cover plate 1
6B grommets
7 battery loader
8 spring element
9A, 9B guides

What is claimed is:

1. A hearing aid device wearable in the ear with a housing comprising:

at least one acceptance for pivoted attachment configured to swivel in and swivel out a battery loader;

a housing opening through which the battery loader can be swiveled in and swiveled out; and a stabilization element to stabilize the housing in the area of the housing opening, attached to the housing and at least partially surrounding the housing opening, wherein, to attach with the housing, the stabilization element at least partially clasps the border area of the housing that surrounds the housing opening.

2. The hearing aid device according to claim 1, wherein the stabilization element is inserted into the housing opening and is attached to the housing on at least two opposite sides of a boundary area of the housing that surrounds the housing opening.

3. The hearing aid device according to claim 1, wherein the housing further comprises:

two acceptances to attach a battery loader;

the stabilization element comprising two openings, wherein, to attach the battery loader with these, connected attachment elements are inserted through the openings of the stabilization element and protrude into the acceptances.

4. The hearing aid device according to claim 1, wherein the stabilization element is fashioned from metal or a metal alloy.

5. The hearing aid device according to claim 1, wherein the stabilization element attaches to the housing to prevent distortions of the housing in an acceptance area of the battery loader.

* * * * *